US009201381B2

(12) United States Patent
Nakai

(10) Patent No.: US 9,201,381 B2
(45) Date of Patent: Dec. 1, 2015

(54) IMAGE FORMING APPARATUS, LIGHT GUIDE MEMBER, AND ELECTRICITY REMOVING DEVICE

(71) Applicant: KYOCERA Document Solutions Inc., Osaka-shi, Osaka (JP)

(72) Inventor: Jun Nakai, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/535,224

(22) Filed: Nov. 6, 2014

(65) Prior Publication Data

US 2015/0132025 A1 May 14, 2015

(30) Foreign Application Priority Data

Nov. 12, 2013 (JP) ..... 2013-233648

(51) Int. Cl.
*G03G 21/00* (2006.01)
*G03G 21/08* (2006.01)

(52) U.S. Cl.
CPC ..... *G03G 21/08* (2013.01)

(58) Field of Classification Search
CPC ..... G03G 21/08
USPC ..... 399/128, 129, 186, 187
See application file for complete search history.

(56) References Cited

U.S. PATENT DOCUMENTS

| | | | | |
|---|---|---|---|---|
| 7,421,229 | B2 * | 9/2008 | Tomiie et al. | 399/128 |
| 2002/0172530 | A1 * | 11/2002 | Kido | G03G 21/08 399/128 |
| 2006/0060751 | A1 * | 3/2006 | Nishimura | G03G 21/08 250/208.1 |
| 2006/0188288 | A1 | 8/2006 | Tomiie et al. | |
| 2011/0243609 | A1 * | 10/2011 | Takami | G03G 21/08 399/128 |
| 2015/0030351 | A1 * | 1/2015 | Wakayama | G03G 21/08 399/128 |

FOREIGN PATENT DOCUMENTS

| | | | |
|---|---|---|---|
| JP | 2005266313 A | * | 9/2005 |
| JP | 2007187805 A | | 7/2007 |
| JP | 2010008725 A | * | 1/2010 |

* cited by examiner

*Primary Examiner* — Francis Gray
(74) *Attorney, Agent, or Firm* — Alleman Hall McCoy Russell & Tuttle LLP

(57) ABSTRACT

An image forming apparatus includes a light source, a cleaning portion, and a light guide member. The light source irradiates an image carrying member with light to remove electricity from a surface of the image carrying member after formation of an electrostatic latent image thereon. The cleaning portion cleans the surface of the image carrying member. The light guide member is disposed on an upstream side of the cleaning portion in a rotation direction of the image carrying member, forms a light guide path for guiding the light irradiated from the light source to the image carrying member, and includes at least one reflection surface, wherein an area of the reflection surface on the image carrying member side is lower in reflection ratio than an area of the reflection surface on the light source side.

7 Claims, 3 Drawing Sheets

IMAGE FORMING APPARATUS, LIGHT GUIDE MEMBER, AND ELECTRICITY REMOVING DEVICE

INCORPORATION BY REFERENCE

This application is based upon and claims the benefit of priority from the corresponding Japanese Patent Application No. 2013-233648 filed on Nov. 12, 2013, the entire contents of which are incorporated herein by reference.

BACKGROUND

The present disclosure relates to an image forming apparatus that forms an image by the electrophotography.

In a typical image forming apparatus, such as a printer, that forms an image by the electrophotography, after a toner image is transferred from a photoconductor drum, the electricity is removed from the photoconductor drum by the electricity removing light that is irradiated from a light source of an electricity removing device. Meanwhile, to increase the print speed of the image forming apparatus, it is necessary to increase the linear speed of the drum. This shortens the time period from the time of removal of electricity by the electricity removing device to the time of charging of electricity by the charging device. In particular, since miniaturization of a housing is also demanded for the image forming apparatus, the space inside the housing in which the components are arranged is limited, and it is difficult to arbitrarily select the location for disposing the electricity removing device. As a result, the electricity removing device is normally disposed between the cleaning device and the charging device. In this configuration, the time period from the time of removal of electricity to the time of charging of electricity is very short. Accordingly, the electricity is removed insufficiently before the charging starts to be performed, and the carriers trapped on the surface of the photoconductor drum remain as optical memory and appear as dark potential difference, thereby degrading the print quality.

On the other hand, there is known a configuration in which an electricity removing device is disposed between a transfer device, which transfers a toner image from the photoconductor drum, and a cleaning device. According to this configuration, the distance on the circumferential surface of the photoconductor drum from the position where the irradiated electricity removing light is received and the position where electricity is charged by the charging device becomes longer. This ensures the time required for eliminating the carriers trapped on the surface of the photoconductor drum, and makes it possible to increase the rotation speed of the photoconductor drum. On the other hand, there is a problem that the toner remaining on the surface of the photoconductor drum and the toner transferred onto the transfer material are scattered and adhere to the electricity removing device, thereby reducing the amount of the electricity removing light that is irradiated toward the photoconductor drum. In view of this, in a configuration where the electricity removing device is disposed on the upstream side of the cleaning device, a light guide member is provided to protect the electricity removing device from the scattered toner.

SUMMARY

An image forming apparatus according to an aspect of the present disclosure includes a light source, a cleaning portion, and a light guide member. The light source irradiates an image carrying member with light to remove electricity from a surface of the image carrying member after formation of an electrostatic latent image thereon. The cleaning portion cleans the surface of the image carrying member. The light guide member is disposed on an upstream side of the cleaning portion in a rotation direction of the image carrying member, forms a light guide path for guiding the light irradiated from the light source to the image carrying member, and includes at least one reflection surface, wherein an area of the reflection surface on the image carrying member side is lower in reflection ratio than an area of the reflection surface on the light source side.

A light guide member according to another aspect of the present disclosure is disposed on an upstream side of a cleaning portion in a rotation direction of an image carrying member, the cleaning portion configured to clean a surface of the image carrying member. The light guide member forms a light guide path for guiding light, which is irradiated from a light source to remove electricity from the surface of the image carrying member after formation of an electrostatic latent image thereon, to the image carrying member, and includes at least one reflection surface, wherein an area of the reflection surface on the image carrying member side is lower in reflection ratio than an area of the reflection surface on the light source side.

An electricity removing device according to a further aspect of the present disclosure includes a light source and a light guide member. The light source irradiates an image carrying member with light to remove electricity from a surface of the image carrying member after formation of an electrostatic latent image thereon. The light guide member is disposed on an upstream side of a cleaning portion in a rotation direction of the image carrying member. The cleaning portion cleans a surface of the image carrying member. The light guide member forms a light guide path for guiding the light irradiated from the light source to the image carrying member, and includes at least one reflection surface, wherein an area of the reflection surface on the image carrying member side is lower in reflection ratio than an area of the reflection surface on the light source side.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings, for the understanding of the disclosure. It should be noted that the following description is an example of an embodiment of the present disclosure and should not limit the technical scope of the present disclosure.

Outlined Configuration of Image Forming Apparatus 10

Figure 1:
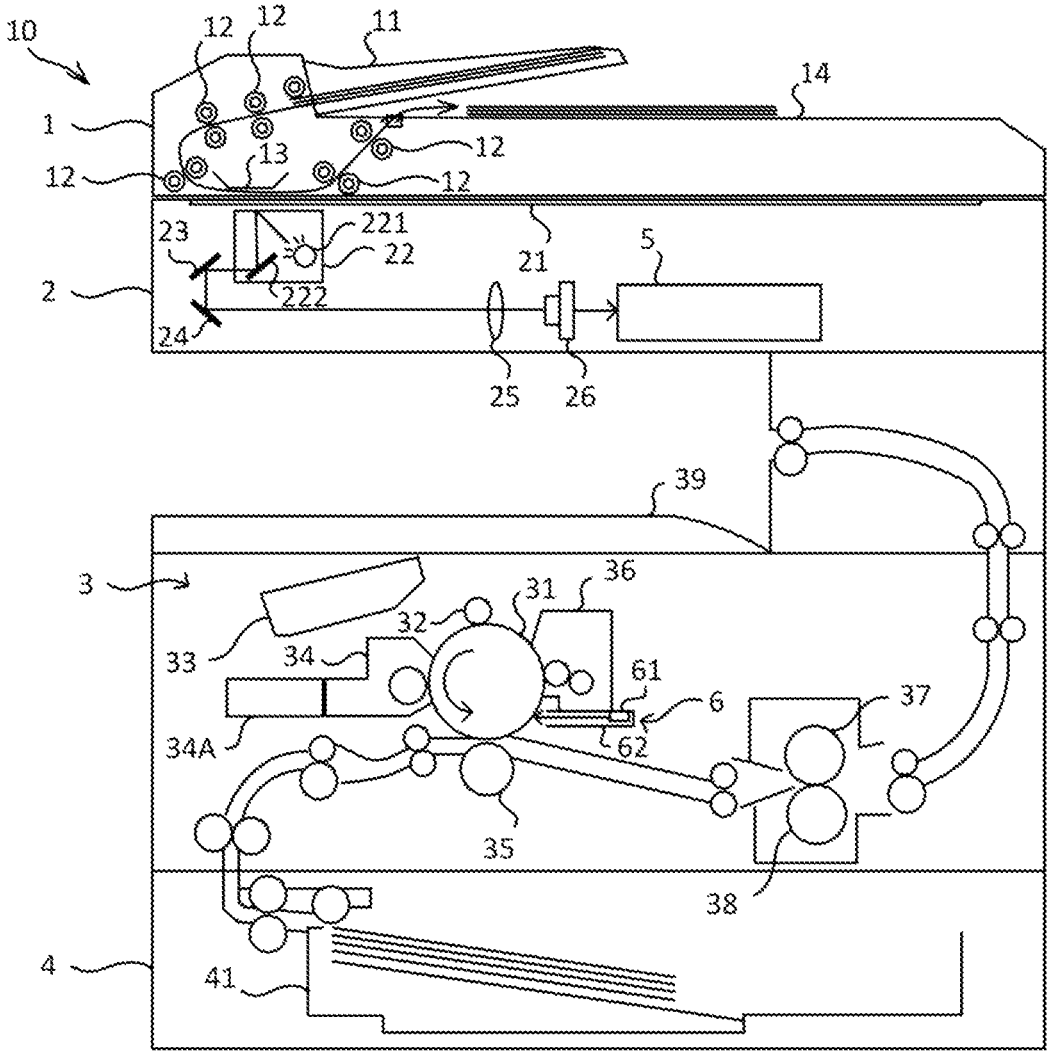
FIG. 1 is a diagram showing the configuration of an image forming apparatus according to an embodiment of the present disclosure.

First, an outlined configuration of an image forming apparatus 10 in an embodiment of the present disclosure will be described with reference to FIG. 1. As shown in FIG. 1, the image forming apparatus 10 includes an ADF 1, an image reading portion 2, an image forming portion 3, a sheet feed portion 4, and a control portion 5. The image forming apparatus 10 is a multifunction peripheral having a plurality of functions such as a scan function, a facsimile function, a copy function and the like, as well as a printer function to form an image based on image data. In addition, the present disclosure is applicable to image forming apparatuses such as a printer apparatus, a facsimile apparatus, a copier, and the like.

As shown in FIG. 1, the ADF 1 is an automatic document sheet feeding device and includes a document sheet setting portion 11, a plurality of conveying rollers 12, a document sheet pressing 13, and a sheet discharge portion 14. In the ADF 1, the plurality of conveying rollers 12 are driven by motors (not shown) such that a document sheet placed on the document sheet setting portion 11 is conveyed and passes an image data reading position where the image data is read by the image reading portion 2, and then conveyed to the sheet discharge portion 14. With this configuration, the image reading portion 2 can read image data from a document sheet conveyed by the ADF 1.

As shown in FIG. 1, the image reading portion 2 includes a document sheet table 21, a reading unit 22, mirrors 23, 24, an optical lens 25, and a CCD (Charge Coupled Device) 26. The document sheet table 21 is a document sheet placing portion provided on the upper surface of the image reading portion 2. The reading unit 22 includes an LED light source 221 and a mirror 222, and is driven by a motor (not shown) to move in the sub scanning direction (the left-right direction in FIG. 1). The LED light source 221 includes a number of white LEDs arranged along the main scanning direction (the depth direction in FIG. 1). The mirror 222 reflects, toward the mirror 23, light which was irradiated by the LED light source 221 and reflected on the surface of the document sheet at the reading position on the document sheet table 21. The light reflected on the mirror 222 is guided into the optical lens 25 by the mirrors 23, 24. The optical lens 25 condenses incident light and makes the condensed light incident on the CCD 26. The CCD 26 includes a photoelectric converting element or the like, wherein the photoelectric converting element inputs an electric signal, which corresponds to the amount of light incident from the optical lens 25, into the control portion 5 as image data of the document sheet.

The control portion 5 includes control equipment (not shown) such as CPU, ROM, RAM, EEPROM, or the like. The CPU is a processor for executing various types of arithmetic processes. The ROM is a nonvolatile storage portion in which various types of information such as control programs for causing the CPU to execute various types of processes are stored in advance. The RAM is a volatile storage portion, and the EEPROM is a nonvolatile storage portion. The RAM and the EEPROM are used as temporary storage memories (working areas) for the various types of processes executed by the CPU. The control portion 5 comprehensively controls the image forming apparatus 10 by causing the CPU to execute the various types of control programs that have been stored in advance in the ROM. It is noted that the control portion 5 may be formed as an electronic circuit such as an integrated circuit (ASIC), and may be a control portion provided independently of a main control portion that comprehensively controls the image forming apparatus 10.

The image forming portion 3 is an image forming portion adopting the electrophotography and executes an image forming process (print process) based on the image data which is read by the image reading portion 2 or input from an external information processing apparatus such as a personal computer. Specifically, as shown in FIG. 1, the image forming portion 3 includes a photoconductor drum 31, a charging device 32, an exposure device (LSU) 33, a developing device 34, a transfer roller 35, a cleaning portion 36, a fixing roller 37, a pressure roller 38, a discharge tray 39, and an electricity removing device 6. In the image forming portion 3, an image is formed in the following procedure on a paper sheet supplied from a sheet feed cassette 41 that is attachable/detachable to/from the sheet feed portion 4, and the paper sheet with the image formed thereon is discharged onto the discharge tray 39.

First, the charging device 32 charges the surface of the photoconductor drum 31 uniformly into a certain potential. Next, the exposure device 33 irradiates the surface of the photoconductor drum 31 with light based on the image data. With this operation, an electrostatic latent image corresponding to the image data is formed on the surface of the photoconductor drum 31. Then the electrostatic latent image on the photoconductor drum 31 is developed (made visible) as a toner image by the developing device 34. It is noted that the toner (developer) is supplied to the developing device 34 from a toner container 34A that is attachable/detachable to/from the image forming portion 3. Subsequently, the toner image formed on the photoconductor drum 31 is transferred to a paper sheet by the transfer roller 35. The print sheet is then conveyed to pass through between the fixing roller 37 and the pressure roller 38, where the toner image having been transferred to the print sheet is heated by the fixing roller 37 so as to be fused and fixed to the print sheet.

On the other hand, after the transfer of the toner image, the electricity charged on the surface of the photoconductor drum 31 is removed by light (electricity removing light) irradiated from a light source 61 of the electricity removing device 6 toward the photoconductor drum 31. In addition, the toner remaining on the surface of the photoconductor drum 31 is cleaned and removed by the cleaning portion 36. After the electricity and toner are removed and cleaned from the surface of the photoconductor drum 31 by the electricity removing device 6 and the cleaning portion 36, the photoconductor drum 31 can transit to the next image formation cycle that begins with the charging by the charging device 32. It is noted that, as shown in FIG. 1, the photoconductor drum 31 is rotated anticlockwise during the image forming process, and the following procedure is executed along the rotation direction of the photoconductor drum 31. Here, the photoconductor drum 31 is an example of the image carrying member.

Meanwhile, in the image forming apparatus 10, the electricity removing device 6 is disposed on the upstream side of the cleaning portion 36 in the rotation direction of the photoconductor drum 31. As a result, on the circumferential surface of the photoconductor drum 31, the distance from the position where the electricity removing light is received from the light source 61 to the position where electricity is charged by the charging device 32 becomes long enough to ensure the time for eliminating the carriers trapped on the surface of the photoconductor drum 31. This makes it possible to increase the rotation speed of the photoconductor drum 31. On the other hand, this configuration generates a problem that the toner remaining on the surface of the photoconductor drum 31 and the toner transferred onto the transfer material are scattered and adhere to the light source 61, thereby reducing the amount of the electricity removing light that is irradiated toward the photoconductor drum 31. In view of this, a light guide member 62 is provided in the electricity removing device 6 to protect the light source 61 from the scattered toner.

Here, to efficiently guide the electricity removing light from the light source 61 to the photoconductor drum 31, it is desirable to increase the reflection ratio of the light guide path that is formed in the light guide member 62. However, in the case where the reflection ratio of the light guide path is high, there is a trouble that, when part of the remaining toner scattered from the surface of the photoconductor drum 31 enters the light guide path and adheres to the light guide member 62, the amount of change of the reflection ratio becomes large. In view of this, in the image forming apparatus 10, the configuration of the light guide member 62 of the electricity removing device 6 is improved so that the amount of change of the reflection ratio due to the adhesion of toner to the light guide member 62 is restricted, and the use efficiency of the electricity removing light of the light source 61 is improved.

The following describes the configuration of the light guide member 62. The light guide member 62 is disposed on the upstream side of the cleaning portion 36 in the rotation direction of the photoconductor drum 31. More specifically, the light guide member 62 is disposed at a position where it faces the outer circumferential surface of the photoconductor drum 31 when the outer circumferential surface moves upward in the vertical direction. The light guide member 62 is elongated in the axis direction of the photoconductor drum 31 (the depth direction in FIG. 2). The light guide member 62 includes a first reflection surface 621 and a second reflection surface 622 that form a light guide path 62R for guiding the light irradiated from the light source 61 to the photoconductor drum 31.

In the light guide member 62, the first reflection surface 621 and the second reflection surface 622 face each other in a direction vertical to the axis direction of the photoconductor drum 31. Specifically, in the image forming apparatus 10, the first reflection surface 621 and the second reflection surface 622 are parallel to each other in the horizontal direction, and face each other in the vertical direction. Among the first reflection surface 621 and the second reflection surface 622, the first reflection surface 621 is positioned on the downstream side and the second reflection surface 622 is positioned on the upstream side in the rotation direction of the photoconductor drum 31.

In each of the first reflection surface 621 and the second reflection surface 622, an area on the photoconductor drum 31 side is lower in reflection ratio than an area on the light source 61 side. Specifically, the first reflection surface 621 includes a high reflection area 621A on the light source 61 side, and a low reflection area 621B on the photoconductor drum 31 side. On the other hand, the second reflection surface 622 includes a high reflection area 622A on the light source 61 side, and a low reflection area 622B on the photoconductor drum 31 side.

The high reflection areas 621A and 622A are areas having a higher reflection ratio than the low reflection areas 621B and 622B. For example, the high reflection areas 621A and 622A are formed from a seal-shaped reflection member adhered to the light guide member 62, the seal-shaped reflection member having a mirror surface that totally reflects light. On the other hand, the low reflection areas 621B and 622B constitute part of the light guide member 62 made of black resin. As a result, the low reflection areas 621B and 622B have a lower reflection ratio than the high reflection areas 621A and 622A. Alternatively, the low reflection areas 621B and 622B may be formed by embossing the surface of the light guide member 62 such that they make light diffuse. In this way, in the light guide member 62, the reflection ratio of the low reflection areas 621B and 622B is set low in advance so that the reflection ratio thereof does not change greatly before and after the adhesion of the toner.

Here, in the first reflection surface 621, a boundary X1 between the high reflection area 621A and the low reflection area 621B is set as a position that halves a length of the light guide member 62 from the light source 61 to an end on the photoconductor drum 31 side. For example, the distance in the light guide member 62 from the light source 61 to the end of the light guide member 62 on the photoconductor drum 31 side is 18.6 mm, and the boundary X1 is at a position 9.3 mm away from the light source 61 toward the photoconductor drum 31.

Furthermore, the boundary X1 is set at an intersection of a tangent line L1 and the first reflection surface 621, the tangent line L1 being a tangent line of the photoconductor drum 31 and passing an end of the second reflection surface 622 on the photoconductor drum 31 side. This is because, among toner particles that are scattered along the rotation direction of the photoconductor drum 31, toner particles that are scattered along the tangent line L1 are considered to enter and reach the deepest part of the light guide path 62R. It is noted that how deep the scattered toner travels the light guide path 62R greatly varies depending on various conditions including the rotation speed of the photoconductor drum 31, the width of the light guide path 62R in the vertical direction, the installation position of the light guide member 62, and the like. As a result, the position of the boundary X1 is not limited to the intersection of the tangent line L1 and the first reflection surface 621, but may be determined as appropriate.

In addition, the toner scattered along the tangent line L1 may collide with the first reflection surface 621 and drop onto the second reflection surface 622 while retaining a propulsive force, or may drop after traveling in a parabolic orbit inside the light guide path 62R. Accordingly, the second reflection surface 622 has a wider toner adhesion range than the first reflection surface 621. In view of this, in the image forming apparatus 10, the length of the high reflection area 621A of the first reflection surface 621 from the light source 61 is greater than the length of the high reflection area 622A of the second reflection surface 622 from the light source 61. It is noted that the length of the high reflection area 622A of the second reflection surface 622 may be determined as appropriate by taking account of various conditions including the rotation speed of the photoconductor drum 31, the width of the light guide path 62R in the vertical direction, the installation position of the light guide member 62, and the like.

The light guide member 62 includes a closing surface 623 for closing an end of the light guide path 62R on the light source 61 side. Due to the rotation of the photoconductor drum 31 or the like, an airflow would occur in the light guide path 62R and flow from an end on the photoconductor drum 31 side toward the end on the light source 61 side. The closing surface 623 restricts such an airflow from occurring, thus restricting the toner from entering the light guide path 62R and reaching a position close to the light source 61.

As described above, in the light guide member 62 of the image forming apparatus 10, the high reflection areas 621A and 622A are provided on the light source 61 side to which the toner is difficult to adhere. With this configuration, in the image forming apparatus 10, the electricity removing light irradiated from the light source 61 is efficiently used. In addition, in the light guide member 62, the low reflection areas 621B and 622B are provided on the photoconductor drum 31 side to which the toner easily adheres. With this configuration, in the image forming apparatus 10, the change of the reflection ratio due to the adhesion of toner is restricted. In this way, in the image forming apparatus 10, it is possible to produce, with good balance, the effects that are in the relationship of trade-off: the effect of restricting the change of the reflection ratio due to the adhesion of toner; and the effect of efficiently using the electricity removing light irradiated from the light source 61.

It is noted that three or more reflection areas having different reflection ratios may be provided in each of the first reflection surface 621 and the second reflection surface 622 of the light guide member 62, based on how easily the toner adheres. This makes it possible to change the reflection ratio in detail based on the level of possibility that the toner adheres to the first reflection surface 621 and the second reflection surface 622 of the light guide member 62, and to improve the use efficiency of the electricity removing light irradiated from the light source 61.

Other Embodiments

Figure 2:
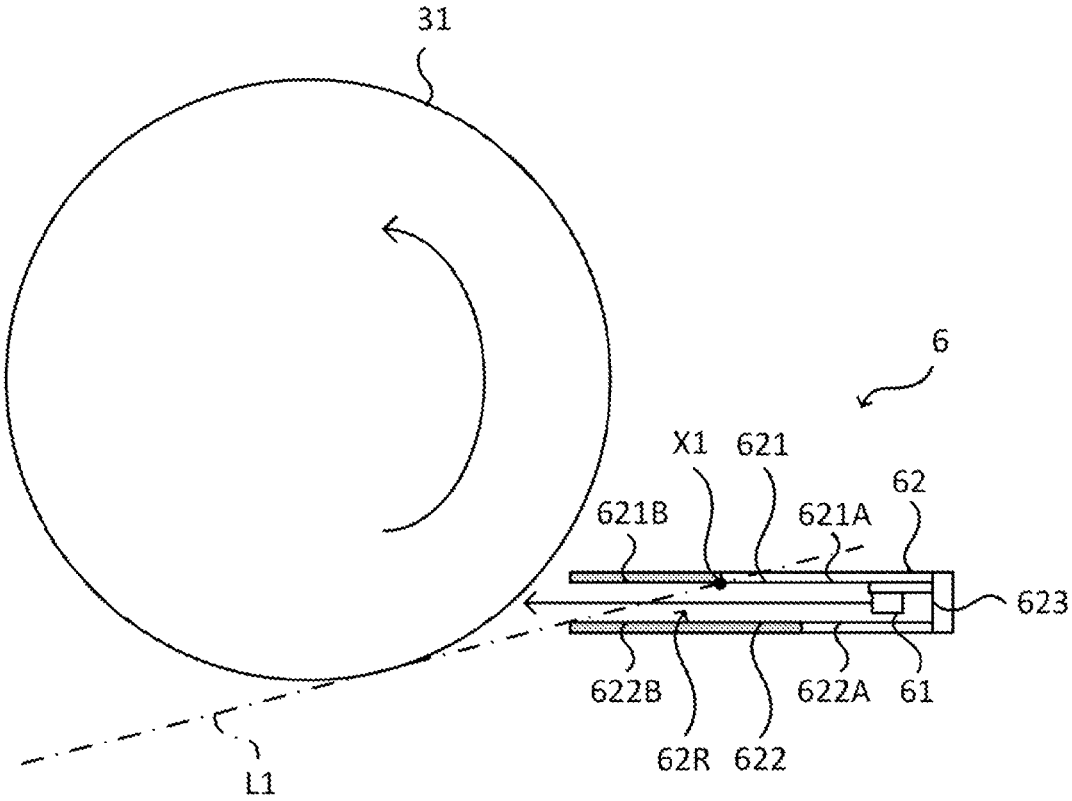
FIG. 2 is a diagram showing an example of the electricity removing device of the image forming apparatus according to an embodiment of the present disclosure.
Figure 3:
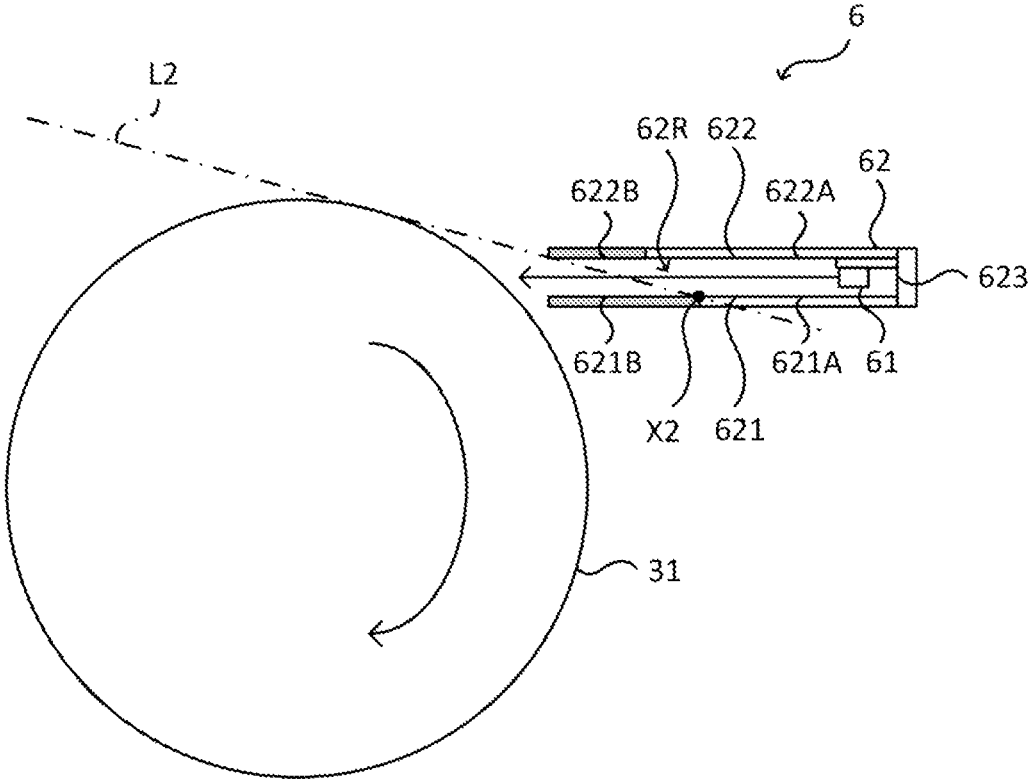
FIG. 3 is a diagram showing another example of the electricity removing device of the image forming apparatus according to an embodiment of the present disclosure.

In the above-described embodiment, as shown in FIG. 2, the light guide member 62 is disposed at a position where it faces the outer circumferential surface of the photoconductor drum 31 when the outer circumferential surface moves upward in the vertical direction. On the other hand, as shown in FIG. 3, as another embodiment, the light guide member 62 of the image forming apparatus 10 may be disposed at a position where it faces the outer circumferential surface of the photoconductor drum 31 when the outer circumferential surface moves downward in the vertical direction. Specifically, such a configuration is adopted in the case where, in the image forming apparatus 10, the photoconductor drum 31 is provided below the conveyance path in which the sheet, on which an image is to be formed, is conveyed. This embodiment is different from the above-described embodiment in areas of the first reflection surface 621 and the second reflection surface 622 to which the toner easily adheres.

Specifically, when the first reflection surface 621 is located below the second reflection surface 622 in the vertical direction, the first reflection surface 621 has a wider toner adhesion range than the second reflection surface 622. As a result, as shown in FIG. 3, in the light guide member 62 of this another embodiment, a boundary X2 in the first reflection surface 621 between the high reflection area 621A and the low reflection area 621B is set at an intersection of a tangent line L2 and the first reflection surface 621, the tangent line L2 being a tangent line of the photoconductor drum 31 and passing an end of the second reflection surface 622 on the photoconductor drum 31 side. Furthermore, the length of the high reflection area 621A of the first reflection surface 621 from the light source 61 is smaller than the length of the high reflection area 622A of the second reflection surface 622 from the light source 61. With this configuration, it is also possible to produce, with good balance, the effects that are in the relationship of trade-off: the effect of restricting the change of the reflection ratio due to the adhesion of toner; and the effect of efficiently using the electricity removing light irradiated from the light source 61.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a light source configured to irradiate an image carrying member with light to remove electricity from a surface of the image carrying member after formation of an electrostatic latent image thereon;

a cleaning portion configured to clean the surface of the image carrying member; and a light guide member disposed on an upstream side of the cleaning portion in a rotation direction of the image carrying member, the light guide member forming a light guide path for guiding the light irradiated from the light source to the image carrying member, and including at least one reflection surface, wherein an area of the reflection surface on the image carrying member side is lower in reflection ratio than an area of the reflection surface on the light source side, wherein the light guide member is elongated in an axis direction of the image carrying member, and the at least one reflection surface is two reflection surfaces arranged to face each other in a direction vertical to the axis direction; and each of the reflection surfaces includes a high reflection area located on the light source side and a low reflection area located on the image carrying member side.

2. The image forming apparatus according to claim 1, wherein the light guide member is disposed to face an outer circumferential surface of the photoconductor drum when the outer circumferential surface moves upward in a vertical direction, and includes the two reflection surfaces facing each other in the vertical direction, and the two reflection surfaces are: a first reflection surface located on the downstream side in the rotation direction of the image carrying member; and a second reflection surface located on the upstream side in the rotation direction of the image carrying member, and the high reflection area of the first reflection surface is longer than the high reflection area of the second reflection surface.

3. The image forming apparatus according to claim 1, wherein the light guide member is disposed to face an outer circumferential surface of the photoconductor drum when the outer circumferential surface moves downward in a vertical direction, and includes the two reflection surfaces facing each other in the vertical direction, and the two reflection surfaces are: a first reflection surface located on the downstream side in the rotation direction of the image carrying member; and a second reflection surface located on the upstream side in the rotation direction of the image carrying member, and the high reflection area of the first reflection surface is shorter than the high reflection area of the second reflection surface.

4. The image forming apparatus according to claim 2, wherein a boundary between the high reflection area and the low reflection area in the first reflection surface is located at an intersection of a tangent line of the image carrying member and the first reflection surface, the tangent line passing an end of the second reflection surface of the light guide member on the image carrying member side.

5. The image forming apparatus according to claim 1, wherein the light guide member includes a closing surface that closes an end of the light guide path on the light source side.

6. A light guide member disposed on an upstream side of a cleaning portion in a rotation direction of an image carrying member, the cleaning portion configured to clean a surface of the image carrying member, wherein the light guide member forms a light guide path for guiding light, which is irradiated from a light source to remove electricity from the surface of the image carrying member after formation of an electrostatic latent image thereon, to the image carrying member, and includes at least one reflection surface, wherein an area of the reflection surface on the image carrying member side is lower in reflection ratio than an area of the reflection surface on the light source side, wherein the light guide member is elongated in an axis direction of the image carrying member, and the at least one reflection surface is two reflection surfaces arranged to face each other in a direction vertical to the axis direction; and each of the reflection surfaces includes a high reflection area located on the light source side and a low reflection area located on the image carrying member side.

7. An electricity removing device comprising:

a light source configured to irradiate an image carrying member with light to remove electricity from a surface of the image carrying member after formation of an electrostatic latent image thereon; and a light guide member disposed on an upstream side of a cleaning portion in a rotation direction of the image carrying member, the cleaning portion configured to clean a surface of the image carrying member, the light guide member forming a light guide path for guiding the light irradiated from the light source to the image carrying member, and including at least one reflection surface, wherein an area of the reflection surface on the image carrying member side is lower in reflection ratio than an area of the reflection surface on the light source side, wherein the light guide member is elongated in an axis direction of the image carrying member, and the at least one reflection surface is two reflection surfaces arranged to face each other in a direction vertical to the axis direction; and each of the reflection surfaces includes a high reflection area located on the light source side and a low reflection area located on the image carrying member side.

* * * * *